United States Patent [19]

Leroy

[11] 4,328,031

[45] May 4, 1982

[54] METHOD OF MIXED BLOWING FOR REFINING METALS IN A CONVERTER

[75] Inventor: Pierre J. Leroy, Saint-Germain-en-Laye, France

[73] Assignee: Creusot-Loire, Paris, France

[21] Appl. No.: 213,758

[22] Filed: Dec. 5, 1980

[30] Foreign Application Priority Data

Dec. 28, 1979 [FR] France ..... 79 31990
Feb. 12, 1980 [FR] France ..... 80 03091

[51] Int. Cl.[3] ..... C21C 5/32; C21C 5/34

[52] U.S. Cl. ..... 75/60; 75/51; 75/52

[58] Field of Search ..... 75/51, 52, 60

[56] References Cited

U.S. PATENT DOCUMENTS 3,854,932 12/1974 Bishop ..... 75/60
3,953,199 4/1976 Michaelis ..... 75/60
4,089,677 5/1978 Spenceley ..... 75/60
4,178,173 12/1979 Gorges ..... 75/60

*Primary Examiner*—P. D. Rosenberg
*Attorney, Agent, or Firm*—Robert D. Yeager

[57] ABSTRACT

The present invention concerns a method of introducing refining gas and stirring gas into metal refining converters, and more particularly into converters in steelworks.

To achieve this, the subject of the present invention is a method of blowing oxidizing gases, particularly pure oxygen, to refine metals, and more particularly to refine pig iron into steel, in a converter, by means on the one hand of a lance blowing from top to bottom, and on the other hand by protected tuyeres blowing, vertically or obliquely, from bottom to top, and characterized in that the amount of oxygen blown from bottom to top by the tuyeres is between 3% and 25% of the total amount of oxygen necessary to refine the metal bath, in that this oxygen is blown from bottom to top with a practically constant flow or a decreasing flow, i.e. with a non-increasing flow, in that a stirring gas, neutral or oxidizing, whose flow is variable according to the various phases of blowing, and can even be zero at certain moments, can be added to this oxygen blown from bottom to top, and in that the jets of oxygen blown from bottom to top, whether or not mixed with a stirring gas, have a diameter at least equalling 18 millimeters, and preferably at least equalling 12 millimeters, this diameter being the jet diameter at the outlet of the tuyeres.

3 Claims, No Drawings

METHOD OF MIXED BLOWING FOR REFINING METALS IN A CONVERTER

FIELD OF THE INVENTION

The present invention concerns a method of introducing refining gas and stirring gas into metal-refining converters, and more especially into converters in steelworks.

BACKGROUND

To refine pig iron into steel in converters, blowing with pure oxygen is generally used, which can be carried out in two different ways:

either, from top to bottom by means of a water-cooled lance introduced through the nose of the converter, or, from bottom to top, vertically or obliquely, by means of tuyeres with two or several concentric tubes, generally disposed in the refractory bottom of the converter, and protected against too rapid wear by a peripheral protective agent introduced into the outer tube of each tuyere.

Blowing with pure oxygen by lance, from top to bottom, in vertical converters presents the following two disadvantages, among others:

(a) production of abundant red iron oxide fumes throughout conversion, which constitutes a significant loss of iron;

(b) stirring of the metal bath due exclusively to localized decarbonization in the reaction region whose intensity can only be affected by biasing the decarbonization speed, which is a function of the flow-rate of pure oxygen, which also has to comply with a certain number of constraints. This stirring of the bath by the single decarbonization limits the possibility of action being taken during the conversion process. In particular, a physicochemical imbalance which is sometimes considerable can occur, at certain times in the operation, between the iron oxide content of the slag and the carbon content of the metal bath, with some awkward consequences which are well known to steelmakers. Similarly, the loss of stirring at the end of refining, at low carbon contents, means that the end of the operation is not completely controlled and consequently prevents the steel from being accurately made in the converter with all the required characteristics. Additional metallurgical measures then have to be taken downstream of the converter to remedy this.

With this type of blowing with oxygen by lance, from top to bottom, there is no attempt in practice to reduce the great quantity of red fumes emitted (which is simply recovered and purified), but some steelmakers have tried to bring about stirring of the bath and slag by an additional means, consisting in putting into the solid bottom of the converter porous refractory plugs through which a neutral gas is blown from bottom to top, such as nitrogen or argon, for example, throughout most of the oxygen-blowing with the lance. This additional means gives advantageous results, such as good stirring of the bath, but presents certain disadvantages of its own:

First, such porous plugs can only blow neutral gases, since oxidizing gases and a fortiori pure oxygen would cause far too rapid wear of the porous refractory.

When selecting a neutral stirring gas, it is hard to make a choice between nitrogen, which is a cheap gas, but nitrides the bath and lessens the calorific power of the converter gases, and argon, which does not have the first of these disadvantages but is expensive.

Even with cheap nitrogen, the cost of the neutral gas consumed is significant.

With a neutral gas, the porous refractory plugs are worn quite slowly so that this is a usable blowing method in practice, but such wear is nevertheless quite fast so that such plugs do not have as long a life as the solid bottom and the refractory lining of the converter when blowing from above is used.

To sum up, this method using mixed blowing has advantages but also has considerable limitations.

The second type of pure oxygen blowing in a converter in a steelworks consists in using tuyeres, vertical or oblique, disposed in the refractory bottom of the converter, blowing from bottom to top, and constituted by at least two concentric tubes, the inner tube (or tubes) blowing an oxidizing gas, which can be pure oxygen, and the outer tube having running through it an agent for protecting the tuyere against wear in service.

This second type of pure oxygen blowing in a steelworks converter, from bottom to top, has several advantages over blowing with a lance, from top to bottom, among them and worthy of mention the following two:

A smaller amount of red, iron oxide fumes emitted during blowing.

Excellent stirring of the bath and slag during almost the whole operation, except for the last seconds, however, when the bath reaches low carbon contents. This has been remedied, though, by a very short final stirring by a neutral gas replacing the oxygen in the tuyeres, most often nitrogen, more rarely argon. This final, very short, stirring has none of the disadvantages noted hereinbefore for porous plugs.

However, complete blowing through the bottom has two disadvantages with respect to lance-blowing:

(a) the life of the bottoms provided with tuyeres for blowing, although in the process of being permanently improved, is still less than the life of the lateral refractory linings of the converter.

(b) Any advance in dephosphorization with respect to decarbonization is more difficult, even impossible, to obtain.

The idea then occurred to combine blowing by lance and blowing by tuyeres at the bottom in the same converter, so as to benefit from the advantages of both types of blowing, hopefully minimizing their disadvantages. In this instance, blowing oxygen through the tuyeres at the bottom under a pressure which increases as the carbon content of the bath decreases was even recommended.

But even if the disadvantages of blowing by lance were thus reduced, not to say removed, as far as the lack of stirring was concerned, for example, the disadvantage of the performance of the bottom with tuyeres being less good than that of lateral refractory lining remained. This disadvantage was particularly marked in the case of blowing with oxygen at increasing pressure in the tuyeres at the bottom, since the speed of wear of the tuyeres increases at low carbon contents in the bath with a given flow of oxygen, and even more so with an increased flow.

SUMMARY OF THE INVENTION

The object of the present invention is to achieve a mixed blowing, simultaneously from top and from bottom, which, as it combines the advantages of blowing by lance and blowing by tuyeres, also allows a considerable improvement in the life of bottoms with tuyeres used in this way in such mixed blowing.

To achieve this, the subject of the present invention is a method of blowing oxidizing gases, especially pure oxygen, to refine metals, and more especially to refine pig iron into steel, in a converter, by means of a lance blowing from top to bottom and also simultaneously by means of protected tuyeres blowing, vertically or obliquely, from bottom to top, and characterised in that the amount of oxygen blown from bottom to top by the tuyeres is between 3% and 25% of the total amount of oxygen necessary to refine the metal bath, in that this oxygen is blown from bottom to top with a practically constant flow or a decreasing flow, i.e. with a non-increasing flow, in that a stirring gas, neutral or oxidizing, whose flow is variable according to the various stages of blowing and can even be zero at certain moments, can be added to this oxygen blown from bottom to top, and in that the jets of oxygen blown from bottom to top, whether or not mixed with a stirring gas, have a diameter at the most equalling 18 millimeters, and preferably at the most equalling 12 millimeters, this diameter being the jet diameter at the outlet of the tuyeres.

The stirring gas can be a neutral gas, such as nitrogen or argon, or an argon mixture, i.e. argon containing a little oxygen and containing no other gas except as traces.

This stirring gas can also be an oxidizing gas, such as carbon dioxide or water vapor, whose dissociation products other than oxygen (with the first, carbon monoxide, with the second, hydrogen) have a stirring effect on the bath.

According to a particular characteristic of the invention, the flow of oxygen blown by the tuyeres is kept constant throughout blowing.

According to another particular characteristic of the invention, the flow of oxygen blown by the tuyeres is at decreasring flow throughout blowing or only from a certain moment on. It can also be decreasing first, and constant subsequently.

According to another particular characteristic of the invention, a stirring gas is added to the oxygen blown by the tuyeres, during two periods: a first period of some minutes at the critical moment for decarbonization projections which can occur in the second quarter of the conversion of pig iron with high phosphorus content, and in the third quarter in hematite pig iron; and a second, quite short period, of one to three minutes, towards the end of blowing, at low carbon contents, during which the instantaneous speed of wear of the tuyeres increases rapidly if pure oxygen is blown.

In this second period, at the end of blowing, the stirring gas can be introduced, preferably with increasing flow.

If, in this final period, the flow of oxygen blown by the tuyeres is regulated to decrease, it can be advisable to compensate for the decrease in oxygen flow with an equal increase in the flow of stirring gas, so that the total gaseous flow blown by the tuyeres from bottom to top remains constant.

According to a particular characteristic of the present invention, the jets of oxygen blown from bottom to top have a diameter at the most equalling 18 mm, and preferably at the most equalling 12 mm, at the outlet of the tuyeres. These tuyeres are of course protected against wear in a known way by a peripheral protective agent, such as a hydrocarbon gas, or oil-fuel, or water vapor, or gaseous or liquid carbon dioxide, etc. By comparison, it should be remembered here that the tuyeres conventionally used in methods of complete blowing through the bottom have a diameter of passage for the oxygen which is generally between 28 mm and 36 mm.

The anti-wear protective agent for the tuyeres participates, if necessary, in the stirring of the bath but only slightly, since the flow of protective agent is always very small with respect to the flow of oxygen blown.

According to another particular characteristic of the invention, the amount of oxygen blown from bottom to top by the tuyeres is between 3% and 10% of the total amount of oxygen necessary to refine the metal bath.

According to another particular characteristic of the invention, the powdered materials, such as powdered lime or limestone flux powder to be introduced into the metal bath, are introduced in suspension in the oxygen of the lance, and as the latter represents only a fraction of the total oxygen necessary to refine the metal bath completely, the concentration of powdered materials in the oxygen can be noticeably higher than in methods of complete blowing by lance, which, by cooling the region of reaction of the oxygen from the lance in the bath, helps to lessen the amount of red fumes due to that oxygen.

According to another particular characteristic of the invention, the flow of oxygen blown from bottom to top and, if necessary, the flow of additional stirring gas, are regulated continually as a function of the state of oxidation of the slag, evaluated either by an overall estimate from the known elements or by dosage of samples taken by a sub-lance, measurement of the temperature of the bath, or by means of an apparatus for measuring the intensity of its product by the converter, so as to continually control the departure from equillibrium between slag and metal bath.

DETAILED DESCRIPTION

It will be understood that the type of mixed blowing in accordance with the present invention has many advantages, some of which it shares with some other known types of mixed blowing, and others which are special to the present invention:

1 Depending on the composition of the pig iron, the proportion of oxygen blown by the lance can be increased or decreased, therefore modulated, at each instant of blowing, with respect to the oxygen blown by the tuyeres, which introduces a very great element of flexibility in regulation into the operation.

2 The effect of local overheating caused in the bath by the oxygen from the lance, which results in emission of a considerable amount of red fumes, a source of considerable loss of iron, is very substantially reduced for two reasons: first, the amount of oxygen blown by the lance is here less than that which has to be blown in methods of complete blowing by lance; and second, each cubic meter of oxygen thus blown by the lance can contain a concentration of powdered lime or limestone flux powder which is considerably higher than in methods of complete blowing by lance, so that the cooling effect of the powdered lime or, if necessary, limestone flux powder, decreases overheating of the reaction zone opposite the lance to the same extent and reduces the emission of red fumes proportionally, without the total thermal balance of the metallurgical operation being affected thereby (with the exception of the limestone flux).

3 Another important advantage of the invention is to make a "controlled stirring" of the metal bath possible at any moment, either by variation of the relation of the flows of oxygen blown in from the top and from the bottom, since each cubic meter of carbon monoxide originating from the oxygen blown from the bottom rabbles the bath more rigorously than a cubic meter of carbon monoxide originating from the oxygen blown from the top, or by regulation of the optimal amount of stirring gas, neutral or oxidizing, accompanying the oxygen blown from the bottom. Thus, with two stirring means available, the intensity of the stirring and the speed of decarbonization of the bath are made independent of each other at the instant concerned.

Thus, with complete blowing by lance, any delay in decarbonization caused by conditions of blowing from the top which increase dephosphorization too much (great height of the lance above the bath, good-quality reactive lime, fluid slag) causes an imbalance between the carbon of the bath and the iron oxide of the slag, which manifests itself, some moments after the appearance of this imbalance, in violent reactions and great projections of slags and metal, constituting losses of metal material.

Stirring according to the invention avoids such imbalances occurring, and its optimal regulation allows complete control of the operating method to be obtained.

4 Another important advantage of the invention, also resulting from the advantages cited hereinbefore, is that it allows "rapid conversion", by using high oxygen flows, suitably distributed between the top and the bottom, which nevertheless avoid the risk of projections.

5 The choice of stirring gases, which are, moreover, not always essential, is quite wide: if the nitrogen content of the steel is not important to the quality of steel to be obtained, or even if a certain nitrogen content is required in the steel, for particular purposes, nitrogen, which is cheap, can be used for stirring.

Conversely, if a low nitrogen content is required in the steel, water vapor or carbon dioxide can be used if the total thermal balance of the conversion is excessive, or argon, which is dearer, if the total thermal balance of the operation is intended to be kept the same, as far as possible. Thus, an "argon mixture", with 1% or 2% oxygen, containing only small traces of other gases, and available in oxygen-generating plants, can be used, because it is less expensive than argon. Whatever is used, the consumption of stirring gas remains relatively low, when not zero.

6 Another essential advantage of the invention is an improvement in the life of bottoms and tuyeres with respect to the life of bottoms and tuyeres of converters with complete blowing from bottom to top, for three reasons: first, the amount of oxygen to be blown through the tuyeres during a conversion is between a thirtieth and a quarter of that necessary in complete blowing through the tuyeres, i.e. it is considerably lower; second, the use of tuyeres of smaller diameter (at the most 18 mm, preferably more than 12 mm, instead of 28 mm to 36 mm in known methods of complete blowing from the bottom) ensures a longer life for these tuyeres, and consequently also for the bottoms containing them; lastly, the possible addition of stirring gas, at the end of blowing, with no increase in the flow of oxygen, and preferably, with a decrease in this, can check wear on the tuyeres at the moment when it would be at its greatest in complete blowing from the bottom.

The number and diameter of tuyeres are of course calculated as a function of the flows envisaged for the oxygen blown from bottom to top, with or without stirring gas, and for a conventional blowing pressure from the bottom. The total section of passage of oxygen in all the tuyeres is generally between a thirtieth and a quarter of the section of passage necessary in methods of complete blowing from bottom to top through the tuyeres.

Thus, in the case in which oxygen blown through the tuyeres must represent 20% of total oxygen, i.e. 1/5, tuyeres of 12 mm diameter passage can be used for the oxygen, which, with respect to conventional tuyeres in complete blowing from the bottom, 28 mm in diameter, have a section 5.45 times smaller; this relation being near 5, the same number of tuyeres can therefore be kept as in complete blowing from the bottom, since a volume of oxygen 5 times smaller has to be passed through.

Also, staying with this instance in which the oxygen blown through the tuyeres represents 1/5 of the total oxygen, half as many tuyeres of 17 mm diameter passage for the oxygen can also be used.

To enable the invention to be fully understood, an embodiment of the method according to the invention for refining Thomas pig iron into steel, in a converter of 65 tonnes, will be described hereinafter by way of non-limiting example.

This Thomas pig iron with 3.6% C, 0.4% Si, 0.6% Mn, and 1.8% P, needs about 63 Nm3 of oxygen per tonne to be refined into mild steel.

In the present example, 80% of this oxygen, i.e. 50 Nm3 per tonne of pig iron, is blown in through a lance, accompanied by all the lime necessary for refining, in powder form, i.e. 135 Kg per tonne of pig iron, divided into 110 Kg of powdered lime and 40 Kg of limestone flux powder (since 40 Kg of limestone flux contributes as much CaO as 25 Kg of lime).

The protected tuyeres blow 20% of the total necessary oxygen, i.e. 13 Nm3 per tonne of pig iron.

They have a diameter of passage for the oxygen of 12 millimeters and there are 7 of them. Under 11 effective bars, their gaseous flow is 9.2 Nm3/min per tuyere, i.e. 64.4 Nm3/min for the 7 tuyeres. They are supplied either with oxygen alone or with a combination of oxygen and argon mixture, with 1% or 2% oxygen.

The metallurgical operation, for producing 65 tonnes of mild steel, by mixed blowing lasting 11 minutes and a few seconds, proceeds as follows:

52 tonnes of Thomas pig iron and 22 tonnes of scrap iron are loaded into the converter.

The lance introduces into the converter: 50 Nm3/t×52=2,600 Nm3 of oxygen at the rate of: 240 Nm3/min in operation.

This oxygen is accompanied by 5,720 Kg of powdered lime and 2,080 Kg of limestone flux powder, i.e. 7,800 Kg in all, at at the rate of an average flow of: 710 Kg/min, i.e. an average concentration of powder in the oxygen of: 3 Kg/Nm3, with 0.8 Kg of very cooling limestone flux per normal cubic meter of oxygen. The red fumes are decreased, as a consequence, though not prevented, because of this relatively high concentration of powder and also because of the use of limestone flux powder.

In the 7 tuyeres, for 8 minutes and some seconds, i.e. until a little before the end of decarbonization, a flow of oxygen of 65 Nm3/min under a little more than 11 bars pressure is blown. Then, for the last 3 minutes, the oxygen flow is progressively reduced, in a linear manner, from 65 Nm3/min to 40 Nm3/min, while an increasing flow of argon mixture is introduced, from 0 to 25 Nm3/min. Consumption of this stirring gas is thus: about 37 Nm3, i.e. less than 0.6 Nm3 per tonne of steel.

The total volume of oxygen blown through the tuyeres is therefore a little greater than: $65\times8+53\times3=520+159=679$ Nm3, i.e. 13 Nm3/t of pig iron.

It represents about 20% of the total oxygen blown.

After this mixed blowing for 11 minutes and some seconds, removal of the phosphated slag follows, a short afterblow under the second slag is given, if necessary, with the corresponding additions, and 65 tonnes of mild steel is poured into the ladle.

A second non-limiting example of application of the method according to the invention will now be described, in which blowing from bottom to top is reduced to a level approaching the strict minimum necessary. In practice, many cases exist in which a proportion of oxygen blown from bottom to top of between 3% and 10% is already very advantageous. In the example hereinafter, refining of a hematite pig iron in a converter of 65 tonnes is involved, but application to a Thomas pig iron, with high phosphorus content, could be carried out in the same way without difficulty.

The analysis of this hematite pig iron is:

4.5% C—0.92% Mn—0.170% P—0.96% Si.

It needs an oxygen supply of 57 Nm3 to a tonne of pig iron, and an addition of 80 Kg of lime to a tonne of pig iron, divided into 65 Kg of powdered lime and 27 Kg of limestone flux powder (because 27 Kg of limestone flux supplies as much CaO as 15 Kg of lime).

The protected tuyeres blow 7% of the total oxygen, i.e. 4 Nm3 per tonne of pig iron. They have a diameter of passage for the oxygen of 11 millimeters and there are 3 of them. Under a pressure of 10 effective bars, they are capable of a gaseous flow of 6.7 Nm3/min per tuyere, i.e. 20 Nm3/min for the 3 tuyeres.

They are supplied either with oxygen alone or with a mixture of oxygen and argon.

The metallurgical operation for producing 65 tonnes of mild steel by mixed blowing according to the invention for a duration of 11 minutes and some seconds proceeds as follows:

53 tonnes of hematite pig iron and 21 tonnes of scrap irons are loaded into the converter.

The lance introduces into the converter: 53 Nm3/t$\times$53=2,809 Nm3 of oxygen, at the rate of 255 Nm3/min in operation.

This oxygen is accompanied by:

65 Kg/t$\times$53=3,445 Kg of powdered lime and:

27 Kg/t$\times$53=1,431 Kg of limestone flux powder, i.e. in all:

4,876 Kg, at the rate of an average flow of: 443 Kg/min, i.e. an average concentration of powder in the oxygen of the lance of: 1.74 Kg/Nm3, with 0.5 Kg of very cooling limestone flux per normal cubic meter of oxygen. Red fumes are lessened, but to a lesser extent than in the previous example, because, on the one hand, the proportion of oxygen blown through the lance is higher than in the previous example, and on the other hand a hematite pig iron is involved here, which needs less lime for refining.

In the 3 tuyeres, for 10 minutes, i.e. up to a carbon content of the order of 0.150/0.200%, a flow of oxygen of 20 Nm3/min under 10 effective bars is blown. Then, for the last minute, this flow is reduced to a constant level of 12 Nm3/min and a flow of argon of 8 Nm3/min, which corresponds to an argon consumption of 0.12 Nm3 per tonne of steel, is added to this oxygen flow, which hardly affects the cost price of the steel but substantially contributes to the good performance of the tuyeres and the bottom at this end of blowing.

In 11 minutes and some seconds, the flow of oxygen blown through the tuyeres is therefore a little greater than:

$20\times10+12\times1=212$ Nm3, i.e. 4 Nm3 per tonne of pig iron.

It represents 7% of the total oxygen blown.

Removal of slag then follows: 65 tonnes of steel are poured into the ladle.

To sum up, the combined effect of the small diameter of the tuyeres, lowering of the flow of oxygen per tuyere with respect to a standard tuyere for complete blowing from the bottom, the decrease in the flow of oxygen at the end of blowing and the final addition of stirring gas, during the period in which the tuyeres are most subject to wear, means that the performance of the tuyeres and bottoms is greatly improved with respect to that of the tuyeres and bottoms of methods with complete blowing from the bottom. There is also a significant improvement compared with known mixed methods.

A final advantage of mixed blowing according to the invention can become evident in many cases at the beginning of blowing. Start-up of the jet of oxygen from the lance, at the surface of a more or less solidified metal bath, more or less filled with scrap irons, lime, etc. is known to be quite often very difficult. On the other hand, start-up of refining reactions by the oxygen from the tuyeres is always instantaneous. Also, a particular characteristic of mixed blowing according to the invention consists in starting the blowing with the oxygen of the tuyeres only, for a few seconds, adjusted to a high flow, for example at the maximum oxygen pressure available, blowing from bottom to top, and then introducing the oxygen from the lance, at the same time as returning the oxygen from the tuyeres to its normal rate of flow.

Variants and improvements in detail can of course be envisaged without exceeding the scope of the invention, as well as the use of equivalent means. Thus, all or part of the water vapor can be replaced by sprayed water as possible stirring fluid.

What is claimed is:

1. In a process for introducing oxygen into a bath of molten pig iron to refine it into steel, wherein said oxygen is blown both onto and beneath the surface of said bath from an overhead lance and into the bath through protected tuyeres submerged beneath the surface of said bath, the improvement comprising:

restricting (i) the total amount of oxygen blown through the tuyeres to a range of from 3% to 25% of the total amount of oxygen required to refine said pig iron and (ii) the flow rate of oxygen blown through said tuyeres throughout the process to a constant or decreasing value;

providing said tuyeres with outlet passages for oxygen having a total cross-sectional area equivalent to the minimum value required to deliver said total amount of oxygen to be blown through said tuyeres, either by adjustment of the diameter of said outlets to a value not exceeding 18 millimeters or by adjustment of the number of outlets, or both; and optionally during an early stage of said oxygen blowing but during a late stage of said oxygen blowing, blowing a stirring gas through said tuyeres either in admixture with said oxygen or in substitution therefor.

2. The improvement recited in claim 1 wherein: the total amount of oxygen blown through the tuyeres is restricted to a range of from 3% to 10%; and the diameter of said outlets is adjusted to a value not exceeding 12 millimeters.

3. The improvement recited in claim 1 which further comprises:

maintaining the total flow of gases through the tuyeres at a constant rate.

* * * * *